United States Patent [19]

Best

[11] Patent Number: 4,642,907

[45] Date of Patent: Feb. 17, 1987

[54] THERMAL BIAS AND TIMER RUN-OUT FOR AUTOMATIC DRYER CONTROL

[75] Inventor: Richard A. Best, St. Joseph, Mich.

[73] Assignee: Whirlpool Corporation, Benton Harbor, Mich.

[21] Appl. No.: 790,210

[22] Filed: Oct. 22, 1985

[51] Int. Cl.[4] ..... F26B 21/06

[52] U.S. Cl. ..... 34/48; 34/53; 34/55

[58] Field of Search ..... 34/48, 53, 55

[56] References Cited

U.S. PATENT DOCUMENTS

| | | | |
|---|---|---|---|
| 2,851,790 | 9/1958 | Worst | 34/48 |
| 3,031,768 | 5/1962 | Kurowski | 34/48 |
| 3,112,187 | 11/1963 | Stone | 34/48 |
| 3,159,465 | 12/1964 | Morey | 34/48 |
| 3,180,038 | 4/1965 | Chafee | 34/48 |
| 3,196,553 | 7/1965 | Deaton | 34/53 |
| 3,318,016 | 5/1967 | Chafee | 34/48 |
| 3,394,466 | 7/1968 | Heidtman | 34/53 |
| 3,401,464 | 9/1968 | Fogt et al. | 34/48 |
| 3,409,994 | 11/1968 | Menk | 34/48 |
| 3,475,830 | 11/1969 | Sutton et al. | 34/53 |
| 3,609,873 | 10/1971 | Odle et al. | 34/48 |
| 3,806,308 | 4/1974 | Cahoe et al. | 34/55 |
| 3,942,265 | 3/1976 | Sisler et al. | 34/48 |
| 4,019,259 | 4/1977 | Veraart | 34/48 |
| 4,083,118 | 4/1978 | Cotton | 34/48 |
| 4,132,008 | 1/1979 | Deschaaf | 34/53 |

*Primary Examiner*—William E. Wayner
*Assistant Examiner*—David W. Westphal
*Attorney, Agent, or Firm*—Hill, Van Santen, Steadman & Simpson

[57] ABSTRACT

A control circuit for a clothes dryer wherein a resistor connected in series with a timer to reduce supply voltage to ensure proper operation of the timer, is mounted adjacent an operating thermostat to provide thermal bias. Timer run-out is provided by the inclusion of a back contact on a drive motor centrifugal switch along with a resistor, so that the timer continues to run through its cycle in the event of the interruption of the dryer motor. Timer run-out is also provided in another embodiment which includes a centrifugal switch in series with the operating thermostat in a timer shunting circuit so that the shunt is removed upon interruption of the dryer cycle to supply power to the timer.

19 Claims, 7 Drawing Figures

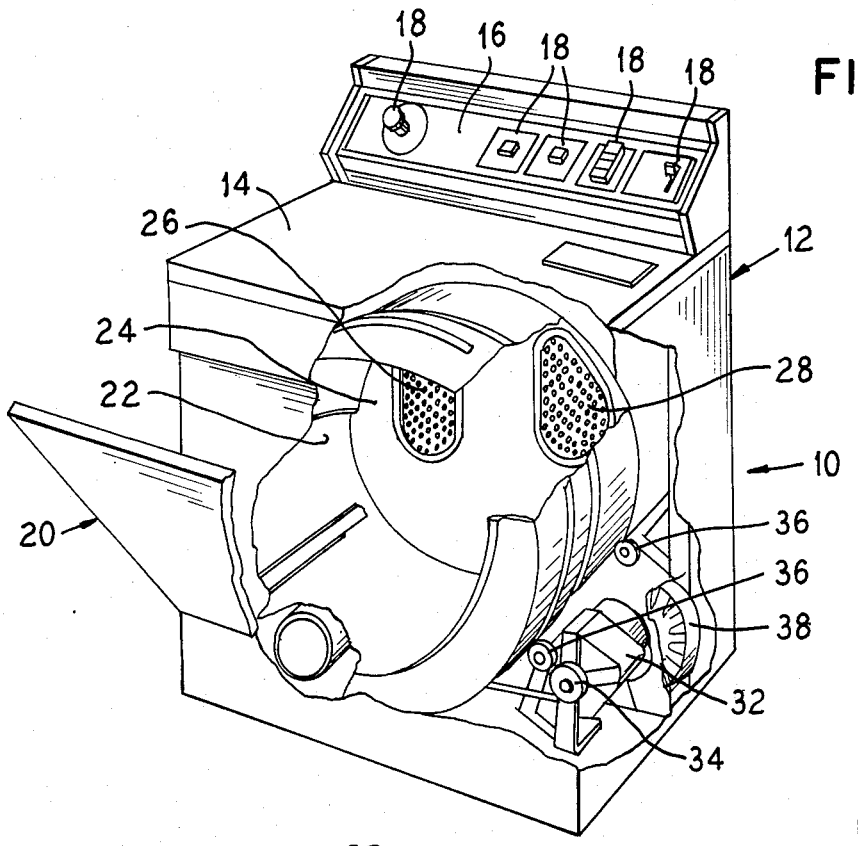
FIG. 1
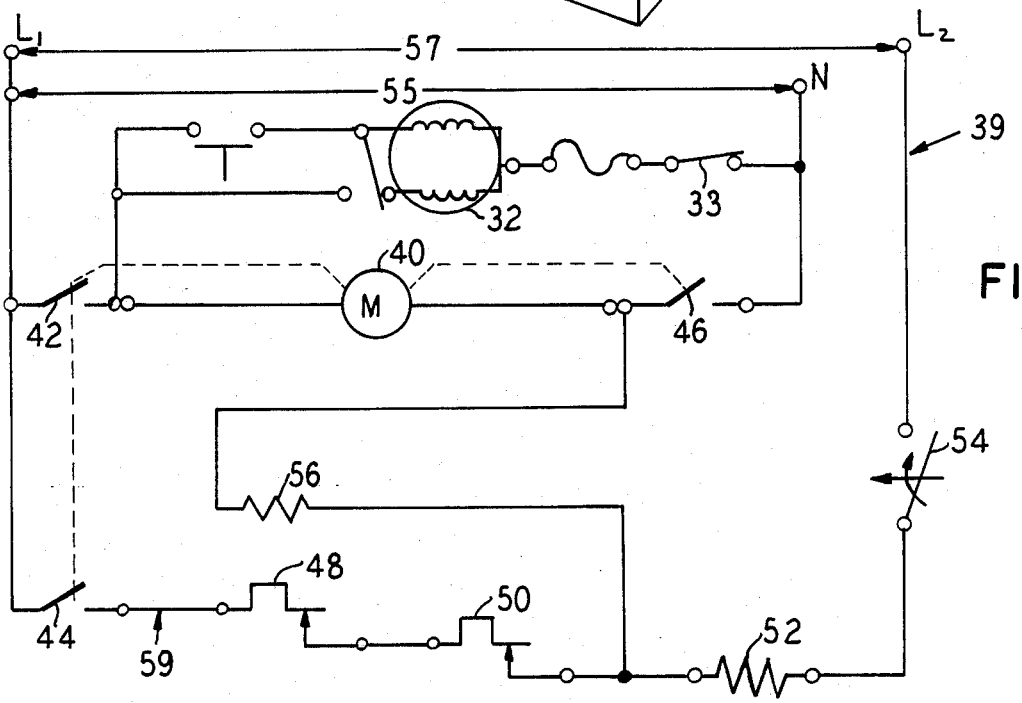
FIG. 2
| switch \ cycle | Automatic | | off | Time | | off | Air | off |
|---|---|---|---|---|---|---|---|---|
| 42 | | | | | | | | |
| 44 | | 10 | | | 5 | | | |
| 46 | | | | | | | | |
FIG. 3

THERMAL BIAS AND TIMER RUN-OUT FOR AUTOMATIC DRYER CONTROL

BACKGROUND OF THE INVENTION

1. Field of the Invention

The present invention relates generally to an automatic clothes dryer, and more particularly, to an electric control circuit for use during an automatic drying cycle which provides thermal bias to an operating thermostat and timer run-out to advance a timer when the dryer is stopped in mid-cycle.

2. Description of the Prior Art

Clothes dryers have employed small heater elements disposed adjacent to an operating thermostat which senses exhaust air temperature from the dryer to provide thermal bias during a drying cycle. The provision of thermal bias causes the thermostat to operate at a lower exhaust air temperature and is commonly used to lower the exhaust air temperature at which the operating thermostat resets thereby reducing cycling of a main heater.

Voltage divider resistors have also been provided in dryer control circuits in series with a timer to drop the voltage applied to the timer. In at least one control circuit, a resistor is disposed in series with a 110 volt AC timer motor across a 220 volt AC line functioning as a voltage divider to prevent burn out of the timer.

A variety of control circuit configurations providing timer run-out are known in the art which enable timer motors to run through their cycles in the event that the drying cycles are interrupted, or upon some other unusual occurrence. Dryer control circuits in which a resistor provides thermal bias to a thermostat are known and are used in dryers currently manufactured by Whirlpool Corporation, the assignee of the present application. The provision of thermal bias is also shown in U.S. Pat. Nos. 3,401,464, where a bias heater is connectable between two power leads; 3,409,994 in which bias heat is provided once a 125° thermostat is tripped; 3,112,187 and 3,318,016, which provide adjustable bias heat; and 3,031,768, which provides continuous bias heat.

Dryer control circuits disclosing the use of a voltage divider in series with a timer include: Whirlpool Corporation wiring diagram No. 695406 which illustrates the control circuit used on clothes dryers it currently manufactures, U.S. Pat. Nos. 3,942,265 and 4,132,008.

A dryer control circuit having the feature of timer run-out is disclosed in U.S. Pat. No. 3,806,308 wherein a timer is independent of a gas heater so that the timer is advanced to "off" should ignition of the heater fail to occur. In U.S. Pat. No. 3,159,465 a thermostat trip near the end of the dry cycle ensures timer run-out, while U.S. Pat. No. 3,196,553 discloses a safety thermostat to advance the timer for small loads. Circuits which provide timer run-out for a door open condition are disclosed in U.S. Pat. Nos. 3,394,466 and 4,083,118. U.S. Pat. Nos. 3,180,038 and 3,609,873 disclose means for removing power from a heater upon the occurrence of a fault condition, such as a power failure or overheated condition.

The prior art thus recognizes the desirability of providing bias heat to an operating thermostat, of providing voltage dividing to a timer motor, and of providing timer run-out in the event a drying cycle is interrupted.

SUMMARY OF THE INVENTION

It is an object of the present invention to provide a low cost, temperature responsive dryer control of the type incorporating thermal bias for an operating thermostat and a voltage divider for a timer.

It is a further object of the present invention to provide means for ensuring that the timer of an automatic temperature responsive dryer control always completes its cycle, thereby opening switches supplying power to the heater, even in instances where the drying cycle is permanently interrupted by a user prior to its completion.

The present invention achieves these and other objects by providing an improved dryer control circuit for use during an automatic drying cycle. The control circuit includes a thermostat heater element in the form of a resistor disposed adjacent to an operating thermostat which provides thermal bias during portions of the drying cycle. The thermostat heater element is connected in series with a timer so that it also functions as a voltage divider to provide the correct operating voltage to the timer. An improvement of the present invention over the devices of the prior art thus resides in the use of a single circuit element which serves both as a voltage divider and as a thermostat bias heater. The present device thus performs the functions recognized as important by the prior art while offering an advantage of a reduction in parts resulting in lower costs and simpler circuit wiring. A further advantage over many of the prior art devices is that a single throw operating thermostat may be used rather than a single pole double throw thermostat.

Several embodiments of the present invention also provide means for enabling the timer to complete its timing cycle which serves to isolate the heater circuit from line power when the timing cycle is interrupted.

In one embodiment of the invention, timer run-out is accomplished by the provision of a back contact on a centrifugal switch on a dryer motor which closes to complete a circuit through the timer when dryer operation is interrupted. A second voltage dividing resistor is connected in series with the back contact and the timer so that the proper voltage is applied to the timer. In another embodiment, the second resistor and the previously mentioned first voltage dividing resistor are formed of a single core having an intermediate connection and two end connections. The single core element is encased in a molded casing and provided with a mounting bracket for easy installation and replacement.

Providing run-out of the timer ensures that timer controlled switches disconnect power from the heater circuit to prevent overheating in the event of control circuit failure and to remove potential shock hazards for service personnel. The single core element provides a further reduction in parts and simplification in circuitry. Another embodiment of the subject invention accomplishes timer run-out by a timer shunt circuit having a centrifugal switch in series with the operating thermostats, which shunt circuit is removed from the circuit by the opening of the centrifugal switch.

BRIEF DESCRIPTION OF THE DRAWINGS

FIG. 1 is a perspective view of an automatic clothes dryer embodying the principles of the present invention.

FIG. 2 is a schematic diagram of an electrical dryer control circuit of the present invention.

FIG. 3 is a time chart showing the operation of timer controlled switches during drying cycles of the dryer control circuit of FIG. 2.

DESCRIPTION OF THE PREFERRED EMBODIMENTS

Figure 4:
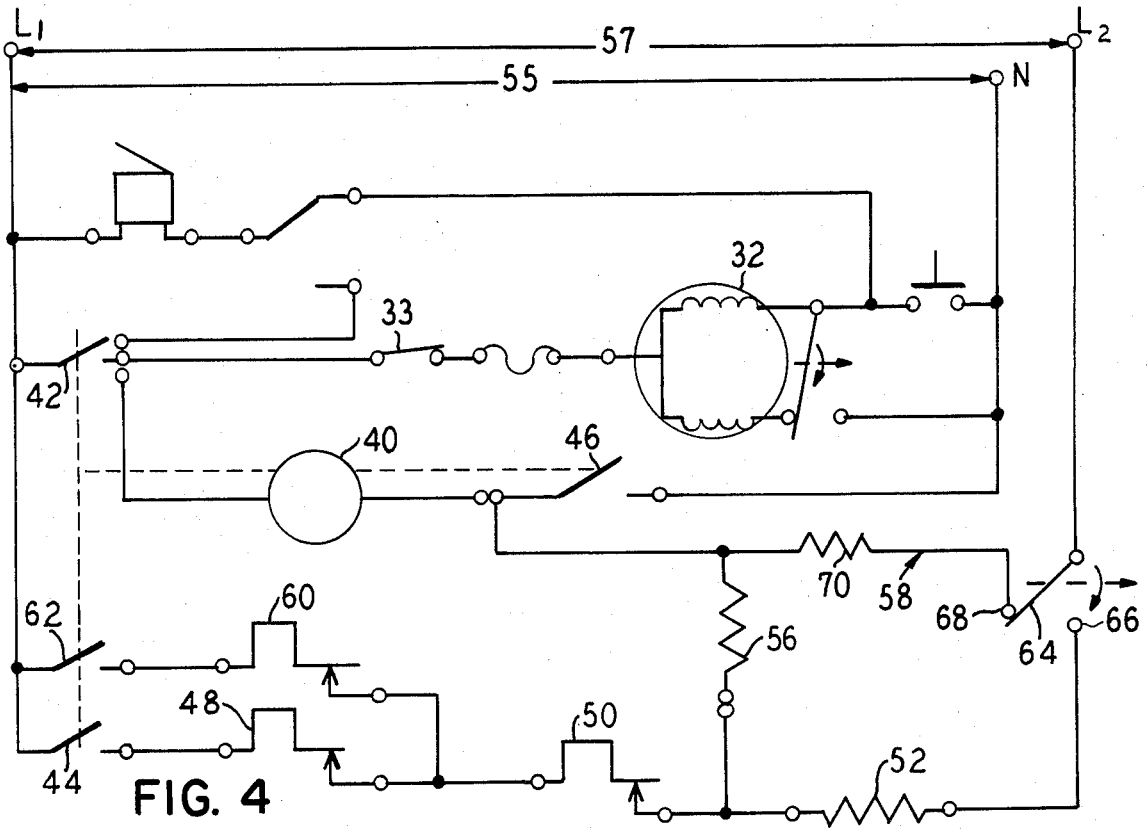
FIG. 4 is a schematic diagram of a second embodiment of an electrical control circuit of the present invention.

In FIG. 1, there is generally shown an automatic clothes dryer at 10 having an exterior cabinet 12 with a top panel 14 having a control console 16 along a rear portion thereof incorporating a plurality of controls 18 for selecting an automatic programmed series of drying steps. The dryer cabinet 12 has a front openable door 20 providing access to the interior of a horizontally rotatable drying drum 22. The drum 22 has a nonrotating rear bulkhead 24 with air intakes 26 and air outlets 28 therein for charging the interior of the drum 22 with heated air from a heater (not shown in FIG. 1) and for exhausting moisture laden air. An electric motor 32 is provided to rotate the drum 22 through a pulley arrangement 34, the drum rotating on a plurality of rollers 36. The motor 32 also drives a fan 38 which provides the air flow through the interior of the drum.

FIG. 2 is an electrical circuit diagram of a dryer control circuit 39 for use in the dryer 10 shown in FIG. 1. The control circuit 39 includes the drive motor 32 and its associated circuitry including a door switch 33, a timer means including timer motor 40, timer operated switches 42, 44 and 46, operating thermostat 48, high limit thermostat 50, heating element 52, centrifugal switch 54, and resistor 56. The control circuit 39 has a low voltage portion 55 across power leads L1 and N which is typically 120 volts, and a high voltage portion 57 across power leads L1 and L2, which is typically 240 volts. The low voltage portion 55 has the drive motor 32 and its circuitry in series with the door switch 33 which is mounted in the dryer to open when the dryer door 20 is opened. Opening of the door switch 32 removes power from the drive motor 32 which stops rotation of the dryer drum 22. Connected in parallel with the drive motor 32 across the low voltage portion 55 is the timer 40 which controls the operation of the dryer 10 through opening and closing of timer switches 42, 44 and 46, the operation of which will be discussed more fully in conjunction with FIG. 3.

In the high voltage portion 57 of the circuit 39 is the operating thermostat 48 which is mounted to sense the dryer exhaust air flow so that it responds to the temperature of the clothes. A high limit thermostat 50 in series with the operating thermostat 48 is also mounted to sense the exhaust air temperature. The high limit thermostat 50 is closed during normal operation and opens only at abnormally high exhaust temperatures for safety purposes, while the operating thermostat 48 is designed to open at a lower temperature.

The main heater element 52, which is generally of low resistance value, is connected in series with the thermostats 48 and 50. The centrifugal switch 54 is connected to the heater 52 and along with the timer switch 44, completes the high voltage portion 57 of the present control circuit 39. The centrifugal switch 54 is physically mounted on the dryer drive motor 32 and is arranged so that it closes during rotation of the motor 32 and opens when the motor stops. Connected from the low voltage portion, between the timer 40 and timer switch 46, to the high voltage portion, between the thermostat 50 and heater 52, is the resistor 56. Compared to the heater 52, it is of high resistance and serves as a voltage divider to provide proper operating voltage to the timer 40 during the automatic drying cycle, as will be discussed hereinafter. Resistor 56 is also mounted adjacent the operating thermostat 48 to provide bias heat thereto. Resistor 56 thus serves a dual function, eliminating the need for a separate thermal bias heater.

The operation of the control circuit 39 will now be discussed in conjunction with the timer switch diagram of FIG. 3. During the first portion of the automatic cycle, switches 42 and 44 are closed and switch 46 is open. Since the thermostats 48 and 50 are closed, current is shunted around the timer 40 and resistor 56 by a shunt path 59. The shunt path enables the heater 52 to operate. When the dryer exhaust air gets hot enough to cause the operating thermostat 48 to open, the shunt 59 is removed and sufficient current flows through the timer motor 40 to cause the timer 40 to advance. Current also now flows through the resistor 56, causing it to apply bias heat to the thermostat 48. Because relatively high impedance has been placed in series with the heater 52 by the opening of thermostat 48, the current flowing through the heater 52 is reduced to a point where the heater 52 provides essentially no heat to the clothes load within the drum 22.

Even with the application of thermal bias to the thermostat 48, it will eventually close, again allowing heat to be applied to the clothes load and shunting the timer 40. The heater 52 will continue to be cycled in this manner, with the timer 40 running each time the operating thermostat 48 opens, until near the end of the automatic cycle as determined by the timer 40, at which time switch 46 closes causing the timer 40 to run continuously through the end of the cycle. Shortly before the end of the timed portion of the automatic cycle, switch 44 opens to remove the shunt path 59 from the circuit, preventing the application of further heat by heater 52. The diagram of FIG. 3 also shows the operation of the timer switches for timed and air dry cycles although these cycles do not utilize the features of the present invention. Thus, it can be seen from the foregoing that the resistor 56 functions both as a voltage divider to supply correct voltage to the timer and as a thermal bias heater to apply heat to the operating thermostat during the automatic drying cycle.

FIG. 4 shows a second embodiment of a dryer control circuit having, for purposes of illustration, some different features than the dryer control circuit of FIG. 2 and which includes the improvement of a timer run-out means 58. The circuit of FIG. 4 has the timer motor 40, the timer switches 42, 44 and 46, the operating thermostat 48, the high limit thermostat 50, the heating element 52 and the resistor 56. Also included in the circuit of FIG. 4 is a second operating thermostat 60 for use during a delicate clothes cycle as well as an associated timer switch 62. The timer run-out means 58 comprises a centrifugal switch 64 having an operating contact 66 and a back contact 68 with a resistor 70 connected thereto. When the dryer motor 32 is rotating, the centrifugal switch 64 is in contact with operating contact 66, just as in the circuit of FIG. 2. However, when the dryer motor 32 ceases rotation, the centrifugal switch 64 moves out of engagement with the operating contact 66 and into engagement with the back contact 68 thereby completing a circuit through the timer motor 40 and the resistor 70. The resistor 70 functions as a voltage divider to reduce the voltage applied to the timer 40 and prevents the timer from burning out, since it is now connected across the 220 volt AC power supplied between leads L1 and L2. It therefore ensures that the timer 40 operates properly and continues to run through its cycle until all timer switches are opened.

Should the drying cycle be interrupted, such as when the dryer door 20 is opened, door switch 33 opens to remove power from the dryer motor 32 and the centrifugal switch 64 moves to the back contact 68, completing a circuit through the timer 40 and the resistor 70 causing the timer 40 to continue running even though the operation of the dryer has otherwise been stopped. The timer 40 eventually opens the timer switches 42, 44, 46 and 62 which completely isolates the heater 52 from line current. This prevents overheated conditions in the dryer should there be failure of the heating circuit, such as a grounding failure. It also prevents a live circuit from remaining in the dryer, thus reducing a potential shock hazard for someone servicing the dryer.

Figure 5:
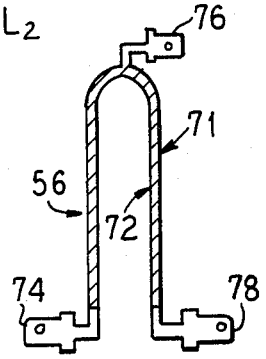
FIG. 5 is a plan view of a voltage divider device which forms a portion of the circuit of FIG. 4.

FIG. 5 shows an improved resistor element, denoted generally 71, for use in the circuit of FIG. 4. The resistor 71 shown in FIG. 5 includes a single piece core, such as a wire wound core 72, to which terminals 74, 76 and 78 have been affixed. The resistor element 71 is used in place of individual resistors 56 and 70 in the circuit of FIG. 4, and since the resistors 56 and 70 are of preferably approximately equal resistance value, the terminal 76 may be attached at or near the midpoint of the wire wound core 72. The combination resistor 71 of FIG. 5 provides a cost savings by replacing the individual resistors 56 and 70 with a single resistor element.

Figure 6:
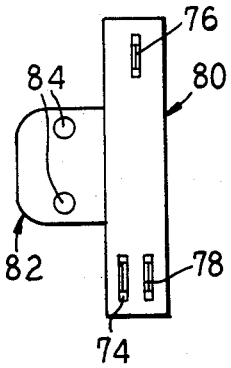
FIG. 6 is a plan view showing the device of FIG. 5 encased for mounting in the dryer of FIG. 1.

FIG. 6 discloses a further improvement of the combination resistor 71 of FIG. 5 wherein the wire wound core 72 is molded into a unitary casing 80. The end contacts 74 and 78 of the resistor 71 can be seen at the lower portion of the casing 80 and the midpoint terminal 76 can be seen at the top portion. Also included is a mounting bracket 82, including mounting holes 84, for attaching the device 71 in the dryer cabinet 12. The encased resistor 71 provides a circuit element which is easy to install and service and which may be adapted for automated assembly.

Figure 7:
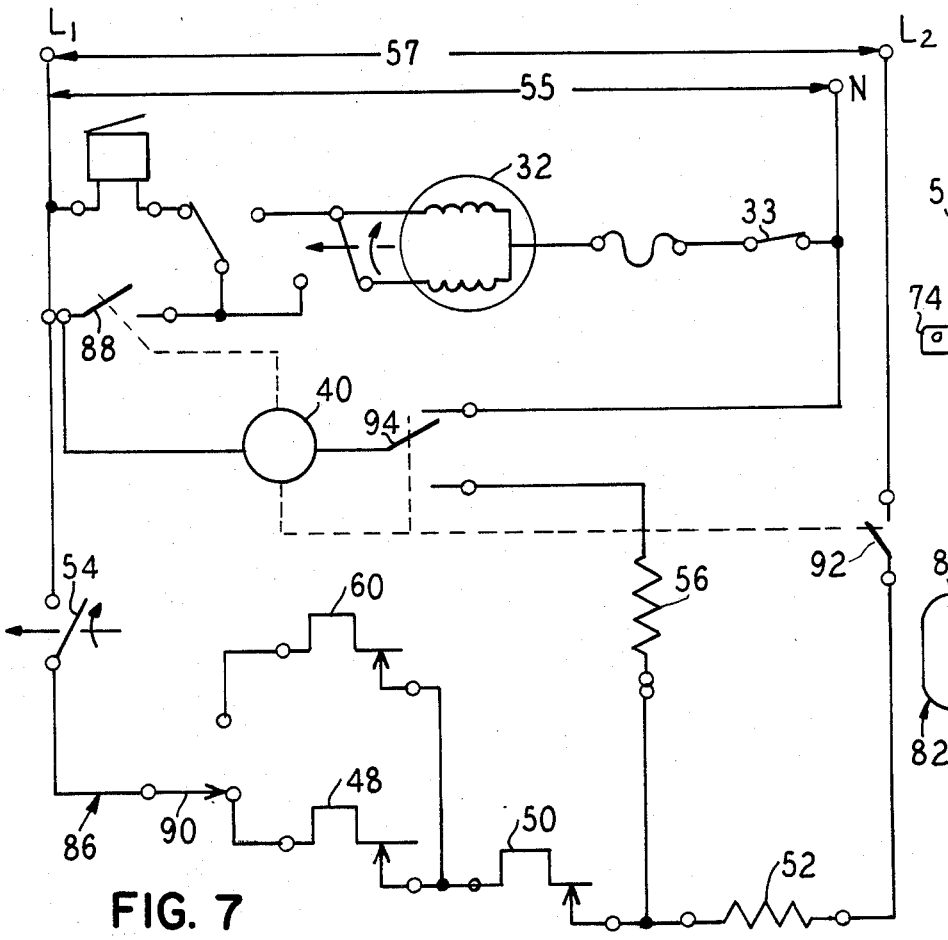
FIG. 7 is a schematic diagram of a third embodiment of an electrical control circuit of the present invention.

FIG. 7 shows a different dryer control circuit having the timer run-out feature. The circuit of FIG. 7, for purposes of illustration, is of a slightly different configuration than the dryer control circuits of FIG. 4 and FIG. 2 and includes a two position timer switch 94. Timer run-out in the present circuit is provided by locating the centrifugal switch 54 in a timer shunting branch 86 of the circuit which has the thermostats 48, 50 and 60. A timer switch 92 is provided in series with the heater 52, and the timer 40 is tied directly to power line L1, instead of through a timer switch. Thus, when the dryer motor 32 is rotating and the centrifugal switch 54 is closed, current flows through the centrifugal switch 54, the temperature selection switch 90, the operating thermostats 48 or 60, the high limit thermostat 50, the heater element 52 and the switch 92. When the motor 32 stops rotating and the centrifugal switch 54 opens, current flows through the timer 40, the timer switch 94, the resistor 56, the heater element 52, and the timer contact 92 causing the timer 40 to run, as described above. Thus, upon interruption of the dryer operation, the timer 40 runs out its cycle. At the end of the automatic cycle, the timer 40 opens the timer switch 92 thereby removing line current from the heater element 52.

The resistor 56 of FIGS. 4 and 7 preferably provides thermal bias to the operating thermostats 48 and 60. However, it can be appreciated that the application of thermal bias is not necessary for the operation of the timer run-out means and therefore the resistor 56 of FIGS. 4 and 7 need not be physically adjacent the operating thermostats.

Thus, there has been disclosed improvements in a dryer control circuit wherein thermal bias is provided to the operating thermostat for improved operation of the dryer cycle. Further, a timer run-out is provided which enables the timer to run through a complete cycle in the event the dryer cycle is interrupted and not continued. The present invention thus provides important safety features and cost savings features over the devices of the prior art.

As is apparent from the foregoing specification the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiment of the invention in which an exclusive property or privilege is claimed are defined as follows:

1. In a control for a clothes drying apparatus having an operating thermostat, the improvement comprising:

a timer operable upon receiving a predetermined current;

a timer shunt branch removable by the opening of the operating thermostat to shunt current around said timer;

means for providing bias heat to the operating thermostat, said means connected in series with said timer and forming a current carrying branch for the predetermined current to enable said timer to advance upon the removal of said shunt branch.

2. In a control for a clothes dryer apparatus having an operating thermostat, the improvement comprising:

a timer, a timer shunt branch removable by the opening of the operating thermostat;

means for providing bias heat to the operating thermostat, said means connected in series with said timer to enable said timer to advance upon the removal of said shunt branch; and a centrifugal switch disposed in said timer shunt branch and responsive to the operation of the drying apparatus to remove said shunt branch upon the interruption of said operation to permit said timer to advance.

3. In a clothes drying apparatus having a first heater element, an operating thermostat connected at a junction in series with said first heater element for controlling the application of power to said first heater, an improved control comprising:

a timer having a first terminal connected to a power source through a timer operated contact;

a second heating element in the form of a resistor connected between a second terminal of said timer and the junction of said operating thermostat and said first heater, said second heating element being disposed sufficiently close to said operating thermostat to substantially effect the operation of said thermostat and having a resistance selected to permit operation of said timer in series with said first heater during periods when said operating thermostat is open;

whereby said second heating element heats said operating thermostat during at least a portion of a clothes drying operation to reduce thermostat cycling.

4. In a clothes drying apparatus having a heater element and an operating thermostat connected at a junction in series with the heater element for controlling the application of power to the heater, an improved control comprising:

a timer having a first terminal connected to a power source through a timer contact;

a resistor connected between a second terminal of the timer and the junction of the thermostat and said heater, said resistor being positioned in thermal association with said operating thermostat and having a resistance selected to permit operation of the timer in series with the heater during periods when the operating thermostat is open;

a centrifugal switch responsive to operation of the dryer having a front contact and a back contact, said front contact in series with the heater and being closed during operation of said dryer; and a second resistor connected between said second terminal of said timer and said back contact to permit operation of said timer when said centrifugal switch engages said back contact.

5. In an automatic clothes dryer including a rotatable clothes drum, a control circuit comprising:

a first circuit connected across a first supply voltage;

a second circuit connected across a second supply voltage, said second supply voltage substantially equal to twice the first supply voltage;

a drive motor in said first circuit for rotating the drum;

means for interrupting the operation of said drive motor associated therewith;

a timer in said first circuit in parallel with said drive motor for timing drying cycles;

a plurality of timer contacts in said first and second circuits under control of said timer;

means in said second circuit for sensing the temperature of clothes being dried;

means controllable by said temperature sensing means for applying heat to clothes being dried;

means in series with said temperature sensing means for sensing the interruption of said drive motor;

timer run-out means responsive to said interruption sensing means for enabling said timer to complete a cycle subsequent to interruption of said drive motor; and voltage dividing means connected between said first and second circuits for reducing said second supply voltage for application to said timer, said voltage dividing means being adjacent said temperature sensing means for supplying thermal bias thereto.

6. The clothes drying apparatus control of claim 5, wherein said timer run-out means includes a second voltage dividing means and said interruption sensing means includes a switch contact for connecting said second voltage dividing means between said first circuit and said second circuit.

7. The clothes drying apparatus control of claim 5, wherein said interruption sensing means and said temperature sensing means form a shunt circuit around said timer motor.

8. In an automatic clothes dryer having a rotatable clothes drum and a drive motor for rotating said drum, a control circuit for an automatic drying cycle comprising:

a first circuit connected across a first supply voltage;

a second circuit connected across a second supply voltage, said second supply voltage being substantially twice said first supply voltage;

a plurality of timer controlled switches in said first and second circuits;

a timer in said first circuit operable to control said timer controlled switches;

at least one thermostat in said second circuit for sensing the temperature of clothes being dried in the dryer;

a heater element in said second circuit in series with said thermostat for applying heat to clothes being dried in the dryer;

a first impedance element connected between said first circuit and said second circuit, to reduce said second voltage for operation of said timer, said impedance element being adjacent said thermostat for supplying bias heat thereto.

9. The clothes drying apparatus control of claim 8, further comprising means responsive to rotation of the drive motor for enabling said timer to complete a timer cycle during interruption of the drive motor, said responsive means including a centrifugal switch in said second circuit in series with said thermostat and said heater element.

10. The clothes drying apparatus control of claim 9, wherein said responsive means includes a back contact on said centrifugal switch and means for connecting said back contact to said first circuit to supply power to said timer.

11. The clothes drying apparatus control of claim 10, wherein said connecting means includes a second impedance element.

12. The clothes drying apparatus control of claim 11, wherein said first impedance element and said second impedance element are formed of a single resistive member having first and second end contacts and an intermediate contact.

13. The clothes drying apparatus control of claim 12, wherein said single resistive member is encased in a molded casing.

14. The clothes drying apparatus control of claim 13, wherein said molded casing is of thermoplastic material.

15. In an automatic clothes dryer including a rotatable clothes drum, a control circuit comprising:

a first circuit connected across a first supply voltage;

a second circuit connected across a second supply voltage;

a drive motor in said first circuit for rotating the drum;

means associated with said drive motor for interrupting the rotation of the drum;

a timer in said first circuit in parallel with said drive motor for controlling drying cycles;

a plurality of switches in said first and second circuits controllable by said timer;

a heater element in said second circuit for applying heat to clothes being dried;

at least one thermostat in said second circuit in series with said heater element for sensing the temperature of clothes being dried;

a first impedance element connected between said first circuit to said second circuit to reduce said second supply voltage for application to said timer;

a centrifugal switch in said second circuit in series with said thermostat and said heater element and associated with the drive motor to open said second circuit when the drive motor ceases rotation;

timer run-out means responsive to opening of said centrifugal switch to enable said timer to complete a timing cycle subsequent to interruption of operation of said dryer motor.

16. The clothes drying apparatus control of claim 15, wherein said timer run-out means includes a back contact on said centrifugal switch, a second impedance element linking said first circuit to said back contact whereby engagement of said centrifugal switch with said back contact completes a series circuit through said timer and said second impedance element.

17. The clothes drying apparatus control of claim 16, wherein said first and second impedance elements include a unitary device having first and second end terminals and an intermediate terminal.

18. The clothes drying apparatus control of claim 17, wherein said unitary device includes a molded thermoplastic casing.

19. The clothes drying apparatus control of claim 15, wherein said centrifugal switch and said thermostat form a series shunt circuit around said timer and said first impedance element.

* * * * *